US009404303B2

(12) United States Patent
Potts et al.

(10) Patent No.: US 9,404,303 B2
(45) Date of Patent: Aug. 2, 2016

(54) CHAIN WINDER FOR A WINDOW OR DOOR

(75) Inventors: Martin Charles Potts, Wakerly (AU); Craig Robert Jeffrey, Eight Mile Plains (AU)

(73) Assignee: Assa Abloy Australia Pty Limited, Oakleigh (AU)

( * ) Notice: Subject to any disclaimer, the term of this patent is extended or adjusted under 35 U.S.C. 154(b) by 85 days.

(21) Appl. No.: 14/005,089

(22) PCT Filed: Mar. 13, 2012

(86) PCT No.: PCT/AU2012/000260

§ 371 (c)(1),
(2), (4) Date: Sep. 13, 2013

(87) PCT Pub. No.: WO2012/122596

PCT Pub. Date: Sep. 20, 2012

(65) Prior Publication Data

US 2014/0001301 A1 Jan. 2, 2014

(30) Foreign Application Priority Data

Mar. 16, 2011 (AU) ..... 2011900941

(51) Int. Cl.

| | |
|---|---|
| ***B65H 75/22*** | (2006.01) |
| ***E05F 11/04*** | (2006.01) |
| ***E05F 11/06*** | (2006.01) |
| ***B65H 75/34*** | (2006.01) |
| ***B65H 75/44*** | (2006.01) |

(52) U.S. Cl.

CPC ..... *E05F 11/04* (2013.01); *B65H 75/34* (2013.01); *B65H 75/4486* (2013.01); *E05F 11/06* (2013.01); *E05Y 2900/132* (2013.01); *E05Y 2900/148* (2013.01)

(58) Field of Classification Search

CPC ..... E05F 15/603; E05F 15/619

See application file for complete search history.

(56) References Cited

U.S. PATENT DOCUMENTS

| | | | | | |
|---|---|---|---|---|---|
| 4,945,678 | A * | 8/1990 | Berner et al. | ..... | 49/322 |
| 5,222,327 | A * | 6/1993 | Fellows et al. | ..... | 49/139 |
| 5,613,321 | A * | 3/1997 | Rizkovsky | ..... | 49/139 |
| 2005/0150324 | A1 * | 7/2005 | Brieseck | ..... | 74/606 R |

FOREIGN PATENT DOCUMENTS

| | | | |
|---|---|---|---|
| AU | 2010101266 | B4 | 12/2010 |
| CN | 1247264 | A | 3/2000 |
| CN | 1405465 | A | 3/2003 |

(Continued)

OTHER PUBLICATIONS

International Search Report for corresponding PCT Application No. PCT/AU2012/000260 dated Apr. 13, 2012.

Written Opinion for corresponding PCT Application No. PCT/AU2012/000260 dated Apr. 19, 2012.

(Continued)

*Primary Examiner* — Sang Kim

(74) *Attorney, Agent, or Firm* — Renner, Otto, Boisselle & Sklar, LLP

(57) ABSTRACT

The present invention relates to a chain winder which has a casing, a chain housed at least partially within the casing and extension means operable to cause the chain to extend out from the casing and also to retract back into the casing. The chain winder also includes a clutch mechanism which is operable to allow the chain to be extended out from the casing, or retracted back into the casing, without operating the extension means.

19 Claims, 12 Drawing Sheets

(56) References Cited

FOREIGN PATENT DOCUMENTS

| | | | |
|---|---|---|---|
| CN | 1423027 | A | 6/2003 |
| EP | 1524397 | B1 | 3/2009 |

OTHER PUBLICATIONS

Office Action and translation for corresponding Chinese Patent Application No. 2012800125788 dated Feb. 16, 2015.

* cited by examiner

CHAIN WINDER FOR A WINDOW OR DOOR

This application is a national phase of International Application No. PCT/AU2012/000260 filed Mar. 13, 2012 and published in the English language.

FIELD OF THE INVENTION

The present invention relates to chain winders for windows or doors.

BACKGROUND

Electric chain winders are available in the marketplace and are used to open and close windows, doors and the like.

Existing chain winders are complex and usually have a lot of moving parts. A problem with existing electric chain winders is that extension and retraction of the chain without an electrical connection, for example during installation, requires the casing to be opened and components to be removed such that the chain can be manually manipulated. Such disassembly may potentially lead to incorrect reassembly and/or faulty operation of the electric chain winder once it is reassembled.

Another problem with existing electric chain winders is that the length of chain extension is determined by the length of the chain that comes with the chain winder, as the end link is usually differently shaped to retain the end of the chain in the casing. If adjustment of the extension amount is required, the casing may need to be opened and the chain shortened or extended by removing or adding additional chain-links. This increases the complexity of installation.

A further problem with existing chain winders and electric chain winders relates to the length of chain which the casing can house. This generally depends on the size of the casing. Chains usually follow a path that allows the chain to curl upon itself. To allow a chain to curl upon itself more than once requires large radii in the chain guides to prevent the chain from jamming or locking up, and such large radii necessitates the use of larger casings.

It is an aim of the invention to overcome or ameliorate one or more of the disadvantages or problems described above, or to at least provide the consumer with a useful or commercial choice.

It will be clearly understood that any reference herein to background material or information, or to a prior publication, does not constitute an admission that any material, information or publication forms part of the common general knowledge in the art, or is otherwise admissible prior art, whether in Australia or in any other country.

DESCRIPTION OF THE INVENTION

In one aspect, the present invention provides a chain winder having a casing, a chain housed at least partially within the casing, extension means for causing the chain to extend out from the casing and also to retract back into the casing, and a clutch mechanism that can allow the chain to be extended out from the casing, or retracted back into the casing, without operating the extension means. In the case of electric chain winders, the extension means may comprise an electric motor or other electrically operated means for extending and retracting the chain.

Preferably the clutch mechanism may be operable (i.e. to allow the chain to be extended out from the casing or retracted back into the casing without operating the extension means) from the outside of the casing. This may enable the chain to be extended or retracted without operating the extension means even when the chain winder is fully assembled (i.e. without requiring any disassembly). This may be particularly useful during installation etc when it may not be possible to operate the extension means (e.g. due to the lack of a connected electrical supply etc).

In another aspect, the present invention provides a chain winder having any one, or any combination of two or more, of the various features or aspects discussed below.

In another aspect, the present invention provides a mechanical clutch for use in a chain winder, the mechanical clutch comprising: a drive member; a driven member; a clutch member mounted for movement (e.g. linear movement) between a first position and a second position relative to the driven member; and a biasing member to bias the clutch member into the first position; wherein, in the first position the clutch member is operatively engaged with the drive member and the driven member such that rotation of either of the drive member or the driven member causes rotation of the other of the respective drive or driven member, and in the second position the clutch member is operatively disengaged from the drive member and/or the driven member against the bias of the biasing member such that rotation of either of the drive member or the driven member does not cause substantial rotation of the other of the respective drive or driven member.

In another aspect, the present invention provides a mechanical clutch for use in a chain winder, the mechanical clutch comprising: a drive member; a driven member which is operatively associated with a chain of the chain winder such that rotation of the driven member in a first direction causes extension of the chain relative to the chain winder and rotation of the driven member in a second direction causes retraction of the chain relative to the chain winder; a clutch member mounted for movement (e.g. linear movement) between a first position and a second position relative to the driven member; and a biasing member to bias the clutch member into the first position; wherein, in the first position the clutch member is operatively engaged with the drive member and the driven member such that rotation of either of the drive member or the driven member causes rotation of the other of the respective drive or driven member, and in the second position the clutch member is operatively disengaged from the drive member and/or the driven member against the bias of the biasing member such that rotation of either of the drive member or the driven member does not cause substantial rotation of the other of the respective drive or driven member.

Typically the mechanical clutch is used in a chain winder such that a chain which is operatively associated with the driven member can be extended and/or retracted relative to the chain winder under drive transmitted from the drive member, and such that the drive member and driven member can be disengaged such that the chain can be extended and/or retracted relative to the chain winder without requiring rotation of the drive member. The drive member may, for example, be operatively associated with a handle and/or motor (e.g. an electric motor) which may not be able to be rotated and/or operated during installation.

In one embodiment, the drive member may be rotatably mounted relative to a casing. Normally the drive member is rotatably mounted on a bushing. However, other means to achieve the same results are envisaged including the use of bearings, surface coatings, surface finishes and/or the like. The drive member may be rotatably mounted to other components of an electronic drive chain winder.

The drive member is typically operatively associated with the chain winder's extension means. For example, in electric chain winders the extension means may be an electric motor such that operation of the motor causes rotation of the drive member.

Typically, the drive member will be substantially circular when viewed from the top. The drive member will normally be annular in shape.

The drive member may have gear teeth or the like to enable it to be driven. The drive member may be driven by a gear that is operatively associated with an electric motor (in the case of an electric chain winder) or operatively associated with a handle (in a non-electric handle-operated chain winder). Alternatively, the drive member may be belt, pulley or friction driven.

If the drive member has teeth or the like, a collar may be associated with the teeth such that gears or the like driving the drive member are kept in engagement with the drive member.

The drive member may have at least one wall defining an aperture such that a clutch member may at least pass partially into and/or through the drive member. Normally the at least one wall defining the aperture comprises features that are adapted to engage with the clutch member.

Typically the drive member will comprise a hollow area defined by the at least one wall such that when the clutch member is in the second position, the features that are adapted to engage with the clutch member in the first position do not engage with the clutch member. Preferably the hollow area will be part of the aperture. The at least one wall defining the hollow area may be adapted to engage with a bushing, bearing, casing, component or the like such that the drive member is rotatably mounted relative to the casing.

Alternatively the drive member may be provided with other features to achieve the same result, including the use of bearing surfaces, guides, pivots, seats, grooves, rims, shoulders, lips and/or the like. No particular limitation should be placed on the invention by the type of feature(s) used to rotatably mount the drive member relative to the casing.

Preferably the upper portion of the drive member includes or is a collar. The collar is normally adapted to partially define the aperture. The collar may be adapted to engage with the driven member and/or components of the chain winder such that the drive member is rotatably mounted relative to the casing. Preferably the collar is adapted to abut the clutch member in the first and/or second position.

In some embodiments, the drive member may have two portions, namely an upper and lower portion. The lower portion may be generally cylindrical. The upper portion may also be generally cylindrical and preferably of a smaller dimension than the lower portion. Preferably, the upper and lower portions will be coaxial.

Normally, there will be a connecting portion between the upper and lower portion. The connecting portion may have an angled wall.

There may be a bore or aperture extending through the upper portion and the bore may extend either into or completely through the lower portion. The bore may be a closed bore at the bottom of the lower portion.

Typically, the lower portion will have a planar lower, preferably circular face. If there is a bore completely through the lower portion, this face will be annular.

An engagement portion is provided circumferentially on the lower portion in order to engage a drive of the chain winder's extension means (e.g. an electric motor or similar). The engagement portion may include one or more teeth or similar engagement mechanisms. The teeth or engagement mechanisms may have any shape or configuration.

The engagement mechanism or teeth may be provided around the entire circumference of the lower portion. The engagement mechanism or teeth may also be shaped to engage the drive in both directions. According to a preferred embodiment, the engagement portion may be provided as an exterior collar portion about the periphery of the lower portion.

The bore in the drive member will preferably be substantially circular in cross-sectional shape. The bore may have different cross-sectional shapes over its length.

A preferred configuration is one in which the bore has one or more engagement portions defined in or by side walls of the bore in an upper portion (this may coincide with the upper portion of the drive member).

The one or more engagement portions may be defined by, or at least partially by, a portion of decreased dimension when compared with a lower portion of the bore (which may coincide with the lower portion of the drive member). That is, an upper portion of the bore may have at least a section of smaller dimension compared to a lower portion of the bore.

The one or more engagement portions provided in the bore may be provided as one or more teeth, crenellations or similar engagement portions in an upper portion of the bore. The one or more engagement portions may also be provided as a series of splines and depressions in or on the side wall of the bore. The splines and depressions may extend a uniform distance downwardly into the bore in order to form a lower circumferential limit of the engagement portion.

The bore below this lower circumferential limit is preferably of increased dimension, typically approximately equal to the dimension of the engagement portion between the depressions.

Therefore, in many embodiments, an uppermost portion of the bore will be continuous and of one dimension, the engagement portion of alternating splines and depressions in which the splines are the same dimension as the uppermost portion and the depressions are of a second dimension is located below the uppermost portion and defined by a lower circumferential limit, and below that is a lower bore portion which is of the second dimension which is the dimension of the depressions in the engagement portion.

The provision of the bore in sections as outlined above may act to guide the clutch member during rotation as well as during the linear movement of engagement and disengagement. Of course there will preferably be sufficient tolerance in the dimensions to allow movement but to limit the chance of slippage.

Preferably, engagement portions will be provided about the internal circumference of the bore in order to spread the load over the drive member and a clutch member.

In another embodiment the clutch member may be mounted for linear movement relative to the driven member. Alternatively, the clutch member may be mounted for linear movement relative to the drive member, axis of rotation of the drive member and/or axis of rotation of the driven member.

Typically, the clutch member will be substantially circular when viewed from the top. However, it is envisaged that the clutch member may be of any suitable shape. No particular limitation should be placed on the invention by the shape of the clutch member.

The clutch member may be provided with features that are adapted to engage with corresponding features on the drive member when the clutch member is in the first position. However, in the second position, the features of the clutch member which are adapted to engage with drive member when in the first position (and the corresponding features on the drive member) are not engaged as they are no longer aligned. Preferably the clutch member will have splines that engage with splines on the drive member. Alternatively other mechanisms for engagement may be provided. For example, the clutch member may be shaped to engage with a corresponding shape on the drive member.

The clutch member may be provided with features that are adapted to engage with corresponding features on the driven member at least when the clutch member is in the first position. Typically the clutch member is provided with features that are adapted to engage with corresponding features on the driven member in the first position and the second position. Preferably the clutch member will have splines that engage with splines on the driven member. Alternatively the clutch member may be shaped to engage with a corresponding shape on the driven member.

The clutch member may be stepped from a larger width to a smaller width such that in the second position the smaller width section of the clutch member does not engage with engaging features on the drive member.

The features, splines or the like on the clutch, drive member and/or driven member may be shaped such that excess force in one direction causes movement of the clutch member into the second position. This may be achieved for example by ramp shaped splines, angled features or the like, where an excess force between the ramp shaped splines, angled features or the like will bias the clutch member into the second position against the force exerted on the clutch member by the biasing member.

The clutch member may comprise a land area such that when the clutch member is in the second position there is no operative engagement between the clutch member and the drive member. The clutch member may additionally include a land area such that when the clutch member is in the second position there is no operative engagement between the clutch member and the driven member. Land areas typically provide smooth areas that do not operatively engage with engagement features of the drive and/or driven members.

The clutch member may comprise a slot, aperture, engageable feature or the like such that a tool can move the clutch member to the second position.

The clutch member is preferably accessible by a tool through at least one aperture provided in the casing of the chain winder. Typically, the casing will have a base, a cover and at least one side. The at least one aperture may be provided in the base, the cover or at least one side. In a preferred embodiment, the casing will have an aperture in the base and an aperture in the cover such that the clutch member is accessible by a tool through the aperture in the base and/or the aperture in the cover. Such an arrangement provides access to the clutch member by a tool if the chain winder is inverted. Preferably the chain winder is adapted to be inverted and/or installed in an inverted position.

Alternatively, other mechanisms for disengaging the clutch may be provided. For example, the clutch member may be or include magnetic material such that when a magnet is placed near the clutch member, the clutch member is biased into the second position.

The clutch member will typically be mounted coaxially with both the drive member and the driven member. The clutch member is typically rotatable about this axis but is also capable of linear movement in an axial direction.

Overall, the clutch member may have a generally cylindrical shape albeit with portions of different cross-sectional dimensions. The clutch member may have a lower portion and an upper portion separated by a body portion. The body portion may have a common dimension to portions of the lower portion (depressions) and to portions of the other member (splines).

The lower portion will typically include one or more engagement portions on an outer surface. The engagement portions may include one or more splines, teeth, crenellations or other similar engagement portions normally separated by depressions. The engagement portions may be provided circumferentially. The engagement portions may be of any shape or configuration.

The preferred depressions or slots (which alternate with splines) may be of suitable dimension to ensure that the lower portions of the depressions are at the same dimension as the body of the clutch member.

The splines and depressions may be rectilinear in shape. Preferably, the outer limit of the splines is uniform circumferentially.

The upper portion may also include one or more engagement portions on an outer surface. The engagement portions may include one or more splines, teeth, crenellations or other similar engagement portions normally separated by depressions. The engagement portions may be provided circumferentially. The engagement portions may be of any shape or configuration.

The splines (which alternate with depressions or slots) are typically of suitable dimension to ensure that the outer portions of the splines are at the same dimension as the body of the clutch member.

The splines and depressions may be rectilinear in shape. Preferably, the inner limit of the depressions is uniform circumferentially.

Preferably, the lower limit of the depressions of the upper portion of the clutch member is spaced from the upper limit of the splines on the lower portion of the clutch member with the body in between. The body typically has no depressions or splines.

In one embodiment, the biasing member may be a spring, magnet, resilient material and/or the like. Normally the biasing member is a compression spring. The biasing member typically biases the clutch member into operative engagement with at least the drive member. The biasing member normally provides a biasing force between the clutch member and the casing. However, other means to achieve the same results are envisaged including providing a biasing force between the clutch member and the drive member or a biasing force between the clutch member and the driven member.

The biasing member will normally be located in a lower portion of the closed bore in the drive member. Typically, the lower portion of the bore will therefore constrain the biasing member in order to prevent, or at least limit, any deformation of the biasing member. Normally, the biasing member will abide by the closed end of the bore in the drive member and an underside or end surface of the clutch member.

The driven member may be rotatably mounted relative to the casing. Preferably the driven member is rotatably mounted on a bushing. However, other means to achieve the same results are envisaged including the use of bearings, surface coatings, surface finishes and/or the like. The driven member may be rotatably mounted to other components of a chain winder. Normally the driven member is rotatably mounted between a chain guide and the casing.

Typically, the driven member will be substantially circular when viewed from the top. There may be circumferentially extending engagement portions provided, on the driven member normally in an annular or ring configuration. The engagement portions may include teeth or similar sufficient to engage a chain (normally these will be received between the pins which connect the links of the chain together). The driven member preferably has a substantially tubular body with a bore entirely therethrough. This will typically be configured as a collar portion above and a collar portion below the circumferentially extending ring of engagement portions.

Preferably, the bore will be provided with engagement portions in the preferred form of alternating splines and depressions. It is preferred that the splines and depressions are rectilinear but any shape which performs the function can be used.

The engagement portions provided will preferably engage with the engagement portions provided on an upper portion of the clutch member. According to a preferred embodiment, the engagement portions provided in the bore of the driven member are not capable of disengagement from the engagement portions on an upper portion of the clutch member while the clutch is assembled regardless of the degree of axial movement of the clutch member. That is, the clutch member is preferably constantly engaged with the driven member.

The depression/movement of the clutch member relative to the driven member will also typically be guided by the corresponding engagement portions of the upper portion of the clutch member and the engagement portions provided in the bore of the driven member. It is preferred that any movement is limited to axial movement without relative rotation.

Normally the driven member will have teeth or the like to operatively engage with a chain. Preferably the driven member is a sprocket which engages with a chain to drive the chain out of and into the casing upon forward and backward rotation of the sprocket. Alternatively, the driven member may be a gear or the like that is operatively associated with a sprocket or the like to cause movement of a chain.

The driven member is preferably engaged with the clutch member when the clutch member is in the first position and when the clutch member is in the second position.

The components of the mechanical clutch are normally made of a suitable metallic material. Alternatively the components may be made from an alloy, plastic, polymer, ceramic, composite and/or any material according to a suitable materials selection chart.

In another aspect, the present invention provides a chain with at least one removable chain limiter plug for use in a chain winder, the chain comprising a plurality of chain-links, each with a pair of substantially parallel chain-link plates and connection pins to attach each chain link to an adjacent chain-link, at least one chain-link having at least one shaped opening, each chain limiter plug including an enlarged head and a body extending from the head, the body being insertable through at least one shaped opening, wherein each shaped opening is adapted to receive the body of a chain limiter plug and allow the body to be secured therein.

In one embodiment, each chain limiter plug may further include at least one extension portion extending laterally from the body, and wherein in use, the chain limiter plug is removeably insertable into at least one shaped opening in at least one of the chain-links of the chain at a position to define an effective length of chain and is rotatable between a first position in which the at least one extension portion engages with the periphery of the shaped opening to be retained therein and in the second position the at least one extension portion is disengaged from the periphery of the shaped opening allowing removal of the chain limiter plug.

The chain-link plates may be substantially planar. Each plate will also typically be unitary. It is preferred that the chain-link plates will each be substantially kidney shaped with a planar spine portion and a pair of lobes, one at either end. There will preferably be a pair of openings in each chain-link plate to accept pins or similar their through. These openings will typically be located one in each lobe of the chain-link plate.

Each chain-link plate will preferably include at least one shaped opening therein. The at least one shaped opening will typically be provided approximately halfway along the length of the plate.

The may often be only a single shaped opening in each chain-link plate. Normally, when the chain is assembled, each link will be formed from a pair of aligned chain-link plates and the shaped opening in each respective link will align with one another.

Each shaped opening may have a number of portions. Typically, there will be a main or central opening which will normally be substantially circular. This main or central opening will also be substantially similar in cross-sectional dimension to be cross-sectional dimension of the body of the chain limiter plug described below.

Each shaped opening will also preferably have at least a pair of apsidal openings, typically offset from one another. There may be at least one larger apsidal opening and at least one smaller apsidal opening which communicate with the main or central opening. Preferably, the apsidal openings will be formed as part of the main or central opening and the periphery of the shaped opening will be continuous.

In some embodiments, there will be two pairs of apsidal openings, with the respective pairs offset from one another, but with the openings in each pair being substantially opposite one another on either side of the main or central opening.

The apsidal openings are preferably sized to either allow passage of the at least one extension portion (larger apsidal opening) when aligned, or to engage the at least one extension portion when the chain limiter plug is rotated to align the at least one extension portion with the smaller apsidal opening.

The engagement between the chain limiter plug and the opening will preferably be a frictional engagement and will normally involve a very small deformation of the periphery of the opening and/or the extension portion. Further, either the periphery of the opening and/or the extension portion will be deformed during movement of the chain limiter plug between the first position and the second position.

The inventors recognised that the chain limiter plug may function if no smaller apsidal opening is provided, that is that the extension portion but the periphery of the shaped opening adjacent the larger apsidal opening, but the provision of the smaller apsidal opening gives a positive engagement with feedback to the user, of the engagement.

It is preferred that the same shaped opening is provided on each and every chain-link plate.

The chain-link plates will normally have features such as tabs that operatively engage with similar feature on adjacent chain-link plates to prevent the chain from substantial bending in one direction. The tabs preferably extend from each link plate from the planar spine along the length of the link plate approximately the same length as the distance between the centres of the pin openings in the link plate (the chain-link pitch). The tab may be planar in cross-section but more preferred is an arcuate cross-section such that a free edge of the tab will be in a different plane to the remainder of the link plate. In this way, alternating links can have link plates which are flipped in relation to one another to allow portions of the tabs to abut one another to prevent unwanted bending of the chain in one direction.

When the chain-link plates are formed into a chain, the increments between shaped openings therein may be substantially equal to the chain-link pitch. Alternatively, the chain-link plates may contain more than one aperture for the chain limiter plug such that when the chain-link plates are formed into a chain, the increments between apertures may be substantially less than the chain-link pitch.

In one embodiment, the head of the chain limiter plug is typically formed integrally with or engages with the body of the chain limiter plug. The head will preferably be larger in cross-section than the body of the plug in order to limit movement into the shaped opening. The head may also stand proud of the link plate in order to engage with other components of the mechanism.

Typically, the head may be any suitable shape but preferably will be substantially circular when viewed from the top. According to a preferred embodiment, the head is provided with a slot, aperture, engageable feature and/or the like such that a tool can rotate the chain limiter plug and/or move the chain limiter plug. The head is preferably accessible by a tool through an aperture in the casing of a chain winder, such that chain limiter plugs may be inserted and/or removed from a chain without opening the casing. The plug may have an engagement means provided in association with the head and/or slot etc in order that the plug can be temporarily attached to the tool for removal and/or insertion from the casing and/or chain.

In another embodiment, the body of the chain limiter plug may be elongate in order to extend into or through both chain-link plates in a link or alternatively, the body may only extend into or through the shaped opening in one chain-link plate of a link.

Preferably the body is substantially cylindrical. However, other shapes to achieve the same results are envisaged. The body normally has a head at one end of the body and a tip or free end at an opposed end.

At least one extension is provided on the plug, normally on the body and according to a preferred embodiment, at least one pair of extensions is typically provided. Each of the pair are preferably offset from one another about the circumference of the plug. Normally, each extension in a pair is substantially opposite the other.

For an elongate chain limiter plug designed to extend through both plates in a link, it is preferred that two pairs of extensions are provided, one pair adjacent to the head of the plug (the upper pair) and a second pair at, but preferably spaced from the free end of the body of the plug (the lower pair). Preferably, each extension in the upper pair may be an elongate ridge extending partially over the length of the body. Normally, each extension in the lower pair will be a discrete extension or knob extension. Where provided, the knob extensions may be of greater dimension that the smaller apsidal openings in the periphery of the shaped opening and may be located such that they pass the opening entirely through the larger apsidal openings (rather than being aligned in the opening) and abut a surface of the link plate when in the first position.

Any portion of the chain limiter plug may be adapted to operatively engage with a microswitch. For example, the chain limiter plug may engage with a microswitch, a leaf spring which is deformable as the limiter plug passes and which engages with a microswitch or the like. Usually, the free end of the chain limited plug will be used for this purpose with the microswitch located in an appropriate position within the housing of the chain winder to allow engagement. Alternatively, the head of the incremental chain limiter plug may be adapted to operatively engage with a microswitch.

In one embodiment, the incremental chain limiter plug may also be used in a manual chain winder. If the incremental chain limiter is used in a manual chain winder, a stop may be provided in the chain winder to retain the incremental chain limiter within the chain winder. The stop may be adapted to engage with the tip of the body and/or the head of the incremental chain limiter plug.

In another embodiment, more than one incremental chain limiter plug may be used with a chain to enable incremental extension or retraction of the chain. For example a chain with two chain limiter plugs may extend to a half open position, defined by the first limiter plug activating a microswitch, the chain may also extend to a fully open position defined by a second limiter plug activating the microswitch.

In one embodiment, the incremental chain limiter plug may be removeably inserted into at least one shaped opening in at least one of the chain-links of the chain. In this embodiment, the incremental chain limiter plug typically does not have to be secured to the chain in use.

The incremental chain limiter plug is normally made of a suitable plastic material. Alternatively the incremental chain limiter plug may be made from an alloy, metallic, polymer, ceramic, composite and/or any material according to a suitable materials selection chart.

In a further aspect, the present invention provides a chain guide for a chain winder, the chain guide defining a chain guide path along which a chain moves during extension and retraction, the chain guide path having at least two substantially parallel linear sections.

The chain guide path may be or include a chain guide track.

The chain guide path may have a coiled or sinuous shape with at least three substantially parallel linear sections and at least two curved sections linking the substantially parallel linear sections. Preferably the chain guide path has three substantially parallel sections and three curved sections.

At least one of the curved sections may turn through substantially 180 degrees. Preferably, at least one of the curved portions may be adapted to accommodate no more than three chain-links at any one time (this may be referred to as a small radius bend or a small radius curved section).

The chain guide path preferably turns through at least 360 degrees. In some embodiments, the chain guide path may turn through more than 430 degrees, often around 450 degrees.

The chain guide typically guides the chain when the chain is extracted and/or retracted. Normally, the chain guide comprises at least one track component located within the casing and defining the chain path. The at least one track component may be a plastic moulded component that inserts into a casing of a chain winder.

Alternatively, or as well as the moulded insert component, at least one track component may be formed integrally with or engages with the casing of the chain winder.

If the at least one track component is inserted into a casing for a chain winder, the at least one track component may be mounted on raiser pads. Additionally, the at least one track component may be secured by bosses restricting any lateral movement.

A pair of track components may be provided, one in either casing portion and which together define a chain guide path there between in a space in the casing (e.g. when the portions of the casing are brought together). The portions on the track components may be substantially identical in order to be able to guide the chain at the upper and lower sides of the chain. Preferably such an arrangement will assist in guiding the chain if the chain winder is in an inverted position. It will be understood that certain parts of the at least one track component may only be provided on one of the upper or lower sides of the chain, for example, a wall member and/or the like.

The chain guide may comprise at least one outer wall defining the outer side (relative to the curved sections) of the chain guide path to guide the chain when the chain is extracted and/or retracted. Typically the chain guide also comprises an inner wall, defining the inner side (relative to the curved sections) of the chain guide path to guide the chain when the chain is extracted and/or retracted. If the chain guide comprises at least one outer wall, a wall of the casing may be adapted to be used as at least one of the at least one outer walls.

In another embodiment, a guide rib may be located between at least two of the at least three substantially parallel sections of the chain guide path. The guide rib may be located between at least two substantially parallel sections of the chain guide path that are connected by a small radius curved section. The rib may prevent the chain from jamming in the chain guide path when the chain bends back on itself around a small radius bend by causing successive chain-links to rotate relative to each other in the small radius curved section. The rib may be formed with or engage with the chain guide. The rib may be part of an inner wall.

Normally the guide rib extends parallel to and between the two parallel linear portions of the guide track which are linked by the small radius bend The guide rib preferably has a free end located at or adjacent the small radius bend.

The guide rib will typically abut the chain as the chain is extended and retracted to guide the chain about the small radius bend and to prevent the links jamming against themselves or the outer wall, Typically, the free end of the guide rib will abut the chain links along their length (often in the area of a depression in the kidney shaped links) in order to force the links outwardly and to prevent jamming of the links. Preferably the rib will include an enlarged bump or protrusion towards the free end of the rib guide to force the links of the chain outwardly and to prevent jamming of the links. Additionally, the inner wall may include an enlarged bump or protrusion towards the entry of any of the curved sections to force the links outwardly and to prevent jamming of the links in the respective curved sections.

In one embodiment, a second chain guide component may be provided in the casing to guide the top of the chain. The second chain guide component may be formed with or engage with the casing of the chain winder. The second chain guide component may be cast as part of the inside of the casing. The second chain guide component typically defines a path that corresponds to the chain guide path. Preferably the at least one component and the second chain guide component are adapted to sandwich the chain from the bottom and top respectively. If a second chain guide component is provided, only one rib may be provided on either the at least one component or the second chain guide component. Alternatively, if a second chain guide component is provided, a second rib may also be provided. Such a second rib may be formed with or engage with the second chain guide component, and may guide the chain from the top.

In another embodiment, the chain guide path may be provided with at least one shoulder. The at least one shoulder may at least partially support the chain, preferably the chain link plates rather than the pins connecting the links or the chain limiter plug which may be received in a depression in the path. Typically, the chain guide path is provided with two shoulders, one on either lateral side of the pins connecting the links. Normally, if the chain guide is provided with two shoulders, one of the two shoulders is provided towards the outer side of the chain guide path and the respective other of the two shoulders is provided towards the inner side of the chain guide path. Preferably, at least one shoulder is at, or descends to, a lower level in at least one of the curved sections of the chain guide path compared to the height of the shoulder in parallel linear sections of the chain guide path. Typically, a lower level shoulder in a curved section will assist the chain in bending around the curved section without jamming or locking up. The second chain guide component may also be provided with corresponding shoulders which will act in the same way when the chain winder is inverted.

For the avoidance of doubt, the present invention may be considered to provide a chain winder which comprises at least one of a mechanical clutch, an incremental chain limiter plug and/or a chain guide as described herein. Throughout this specification, reference to a chain winder may also be a reference to an electronic drive chain winder.

BRIEF DESCRIPTION OF THE DRAWINGS

One or more preferred embodiments of the invention will now be described, by way of example only, with reference to the accompanying drawings in which.

Figure 13:
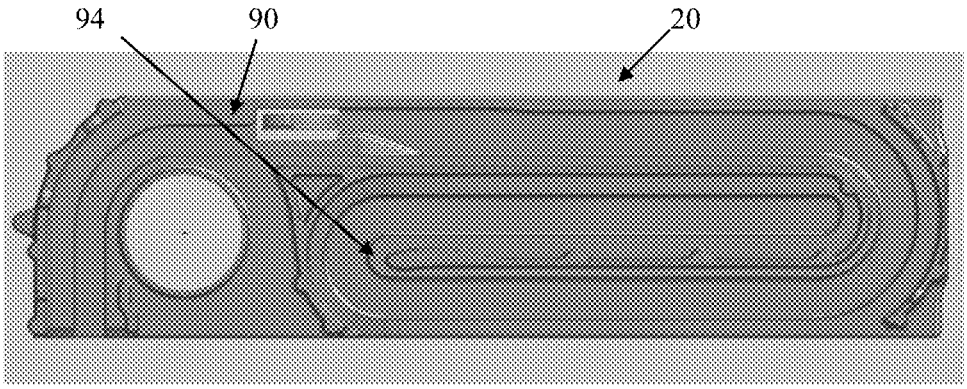
FIG. 13 is a top view of a chain guide.
Figure 13B:
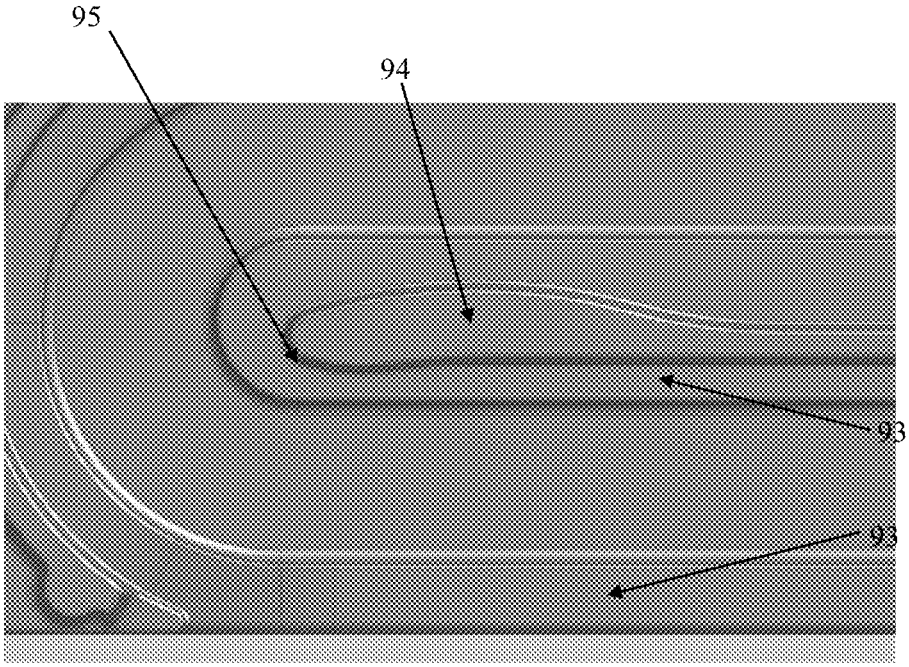

FIG. **13*b* is a detailed view of part of the chain guide in FIG. 13**.

Figure 14:
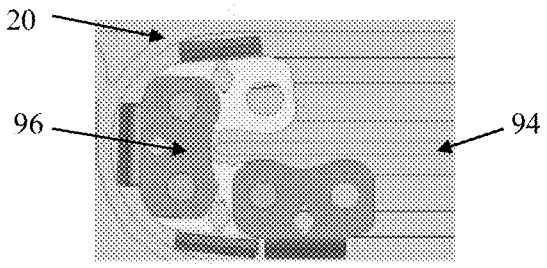

FIG. 14 is a top view of a chain in a chain guide.

Figure 15:
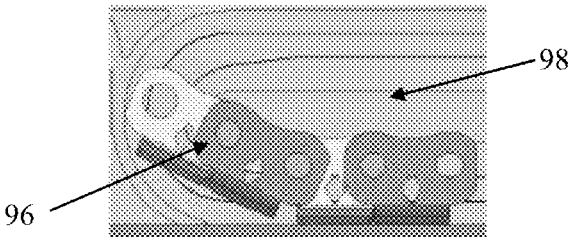

FIG. 15 is a top view of a chain in a chain guide without a rib.

Figure 16:
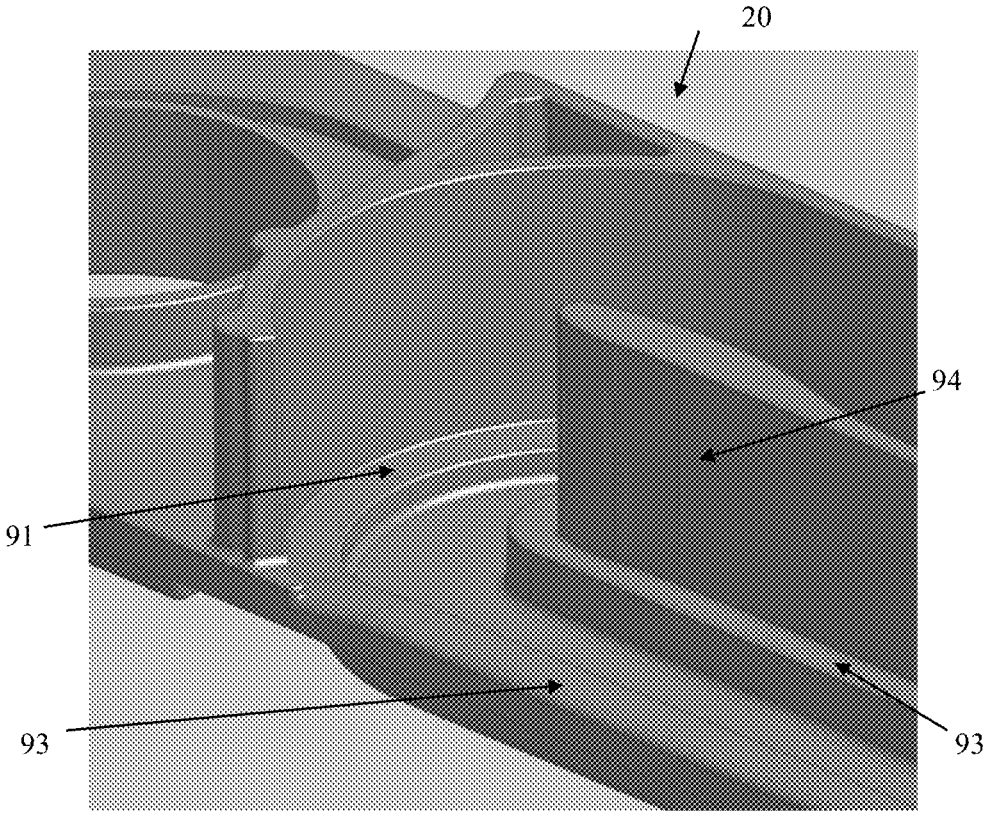

FIG. 16 is another detailed view of part of the chain guide in FIG. 13.

Figure 17:
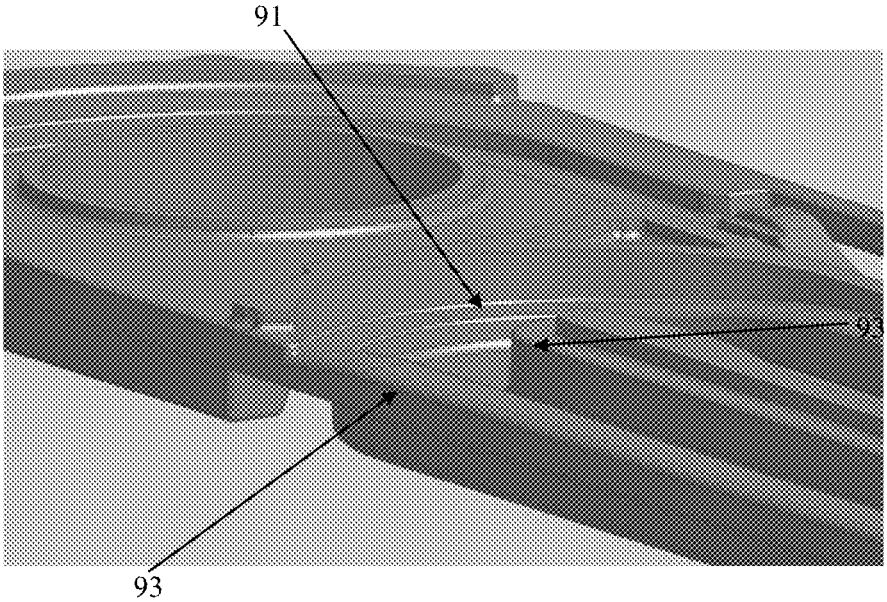

FIG. 17 is a sectioned view of the part of the chain guide in FIG. 16.

DETAILED DESCRIPTION OF THE DRAWINGS

Figure 1:
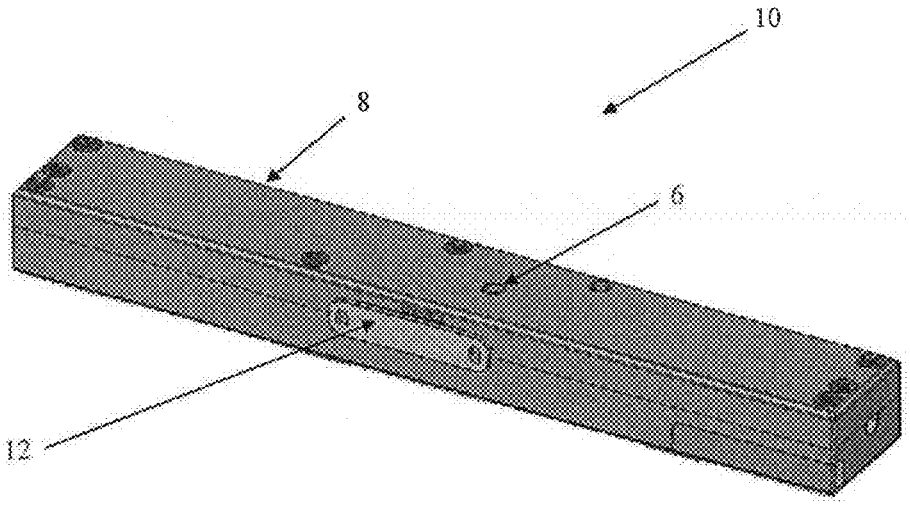
FIG. 1 is an isometric view of an electronic drive chain winder.

With reference to FIG. 1, there is shown an isometric view of an electronic drive chain winder 10 including a casing 8 and a bracket 12 attached to one end to a chain (not shown), and for attaching to a window, door or the like (not shown). As shown in FIG. 1, the casing 8 includes an aperture 6, the purpose of which will be explained later in the specification.

Figure 2:
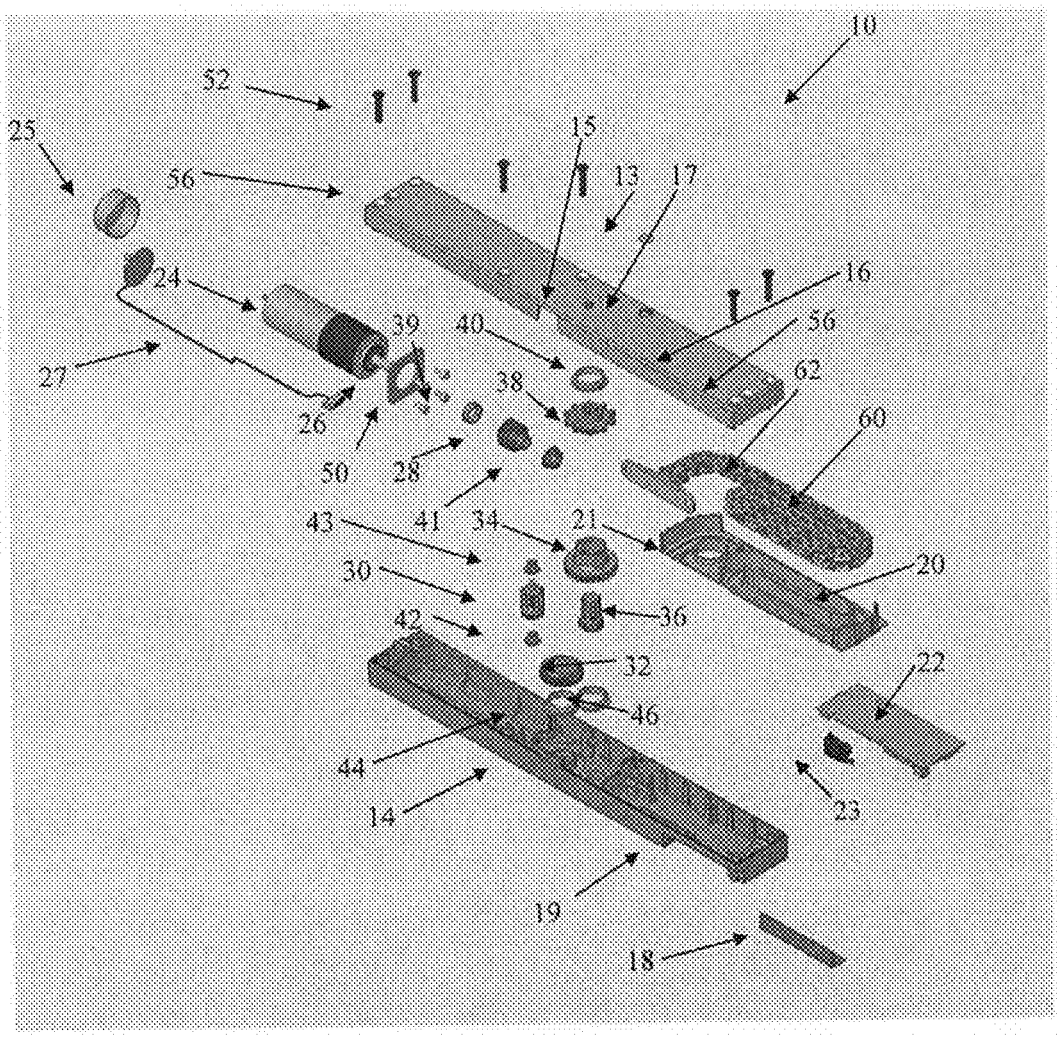
FIG. 2 is an exploded view of the electronic drive chain winder in FIG. 1.

With reference to FIG. 2, there is shown an exploded view of an electronic drive chain winder 10 in accordance with an embodiment of the present invention. This view best shows most of the individual components. A base 14 and a cover 16 act as a housing for the electronic drive chain winder 10. Screws 52 fasten the cover 16 to the base 14. Mounting screws (not shown) mount the electronic drive chain winder 10 to a frame or the like (not shown). The mounting screws (not shown) are inserted through apertures 56 in the cover 16 and through corresponding apertures (not shown) in the base 14. A motor 24 is mounted to a motor mount plate 26 by screws 50. The motor mount plate 26 is held in position between the base 14 and the cover 16. A worm screw 28 is attached to the motor 24. The worm screw 28 is bushed on a bushing 41. The worm screw 28 drives a compound gear 30 which is mounted on a bushing 42 to the base 14. The compound gear 30 is also mounted on a bushing 43 to the cover 16. The compound gear 30 drives a middle gear 32 which is mounted on a bushing 44 to the base 14. The middle gear drives a drive member in the form of a main gear 34 which is mounted on a bushing 46. A clutch member in the form of a clutch gear 36 is mounted within the main gear 34 and is biased into a first position by a biasing member in the form of a spring (not shown) such that male splines on the lower part of the clutch gear 36 engage with female splines on the main gear 34. It will be appreciated from this that, when the clutch gear 36 is depressed into a second position against the biasing force of the spring (not shown), the male and female splines of the clutch gear 36 and main gear 34 respectively will no longer engage with one another. A driven member in the form of a sprocket 38 is mounted on the clutch gear 36 such that male splines on the upper part of the clutch gear 36 engage with female splines in the sprocket 38. It will be appreciated that the male and female splines of the upper part of the clutch gear 36 and sprocket 38 respectively will engage with one another when the clutch gear is in the first position and the second position. A bushing 40 mounts the sprocket 38 to the cover 16. A chain guide 20 is mounted in the base 14 such that the clutch gear 36 projects through an aperture 21 in the chain guide 20. A PCB (printed circuit board) 22 is mounted in the base 14 and controls the motor 24. A microswitch 23 is attached to the PCB 22. The PCB 22 and the microswitch 23 are mounted in the base 14 before the chain guide 20 is mounted in the base 14. The microswitch 23 is adapted to detect a chain limiter plug (not shown). The cover 16 has an aperture 15 such that clutch gear 36 may be accessed by a tool or the like (not shown). The cover 16 has an aperture 17 are such that a chain limiter plug (not shown) may be inserted into and/or retrieved from a chain (not shown). The base 14 has an aperture 19 such that the PCB 22 may be accessed once the components of the electronic drive chain winder 10 have been installed. A cover 18 is adapted to cover the aperture 19. The aperture 19 and cover 18 enable a control cable (not shown) to be connected to the PCB 22 in a number of different ways (for example though the bottom of the cover 18, through the side of the cover 18, between the base 14 and cover 18 and/or the like). A motor cable 27 connects the motor 24 to the PCB 22. A cover 25 covers the back of the motor 24 where the motor cable 27 connects to the motor 24 to protect the connection.

Figure 3:
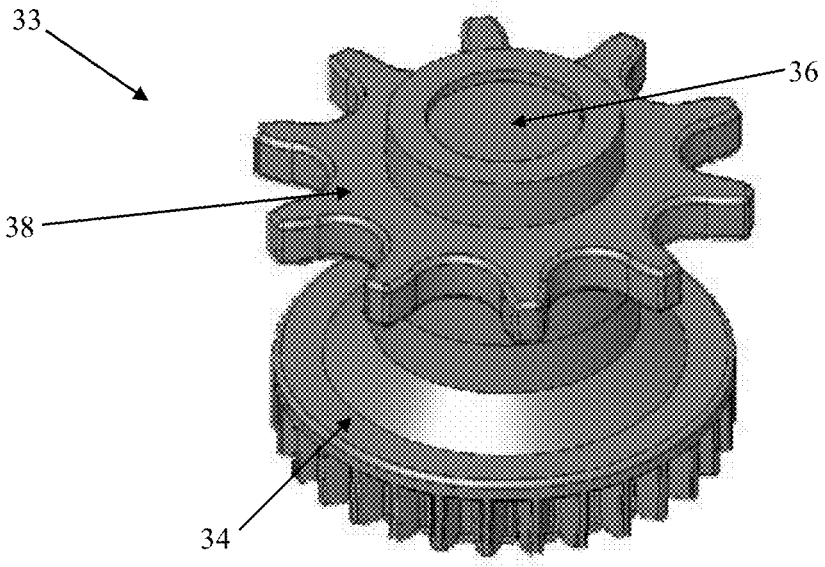
FIG. 3 is an isometric view of a mechanical clutch.
Figure 4:
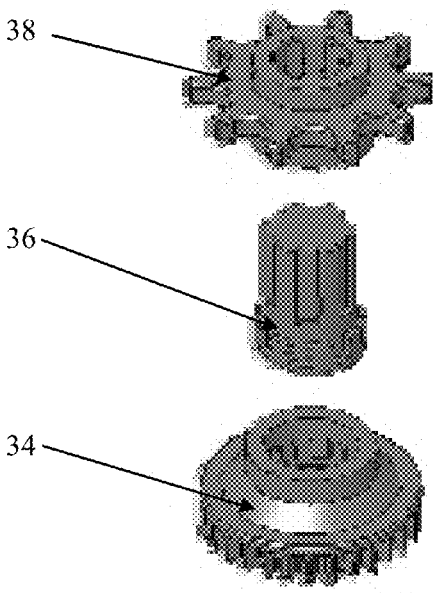
FIG. 4 is an exploded view of the mechanical clutch in FIG. 3.
Figure 5:
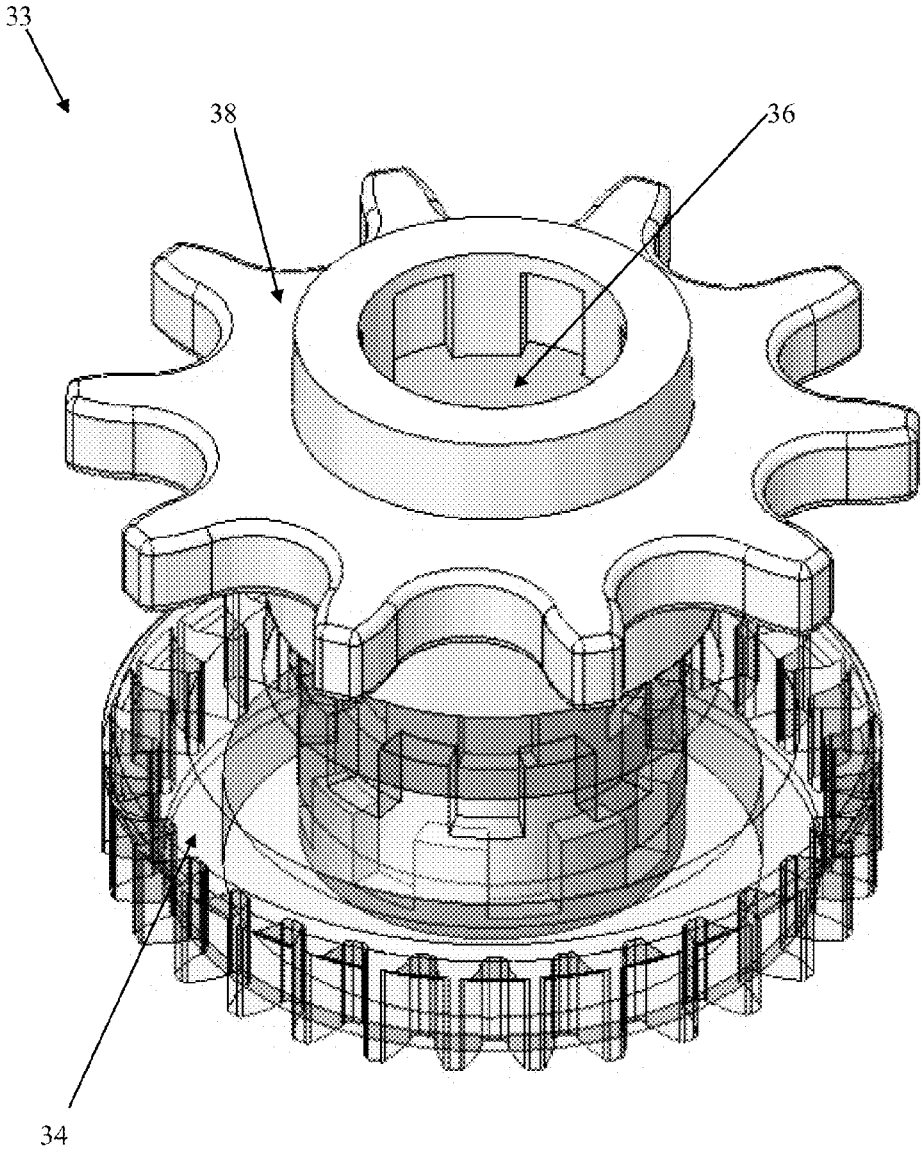
FIG. 5 is another isometric view of the mechanical clutch.
Figure 6:
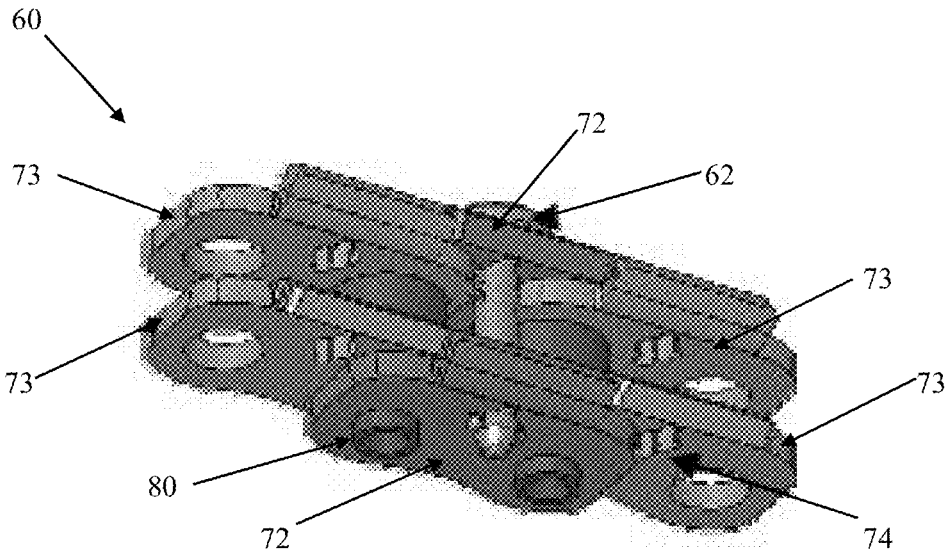
FIG. 6 is an isometric view of part of an incremental chain limiting assembly.
Figure 7:
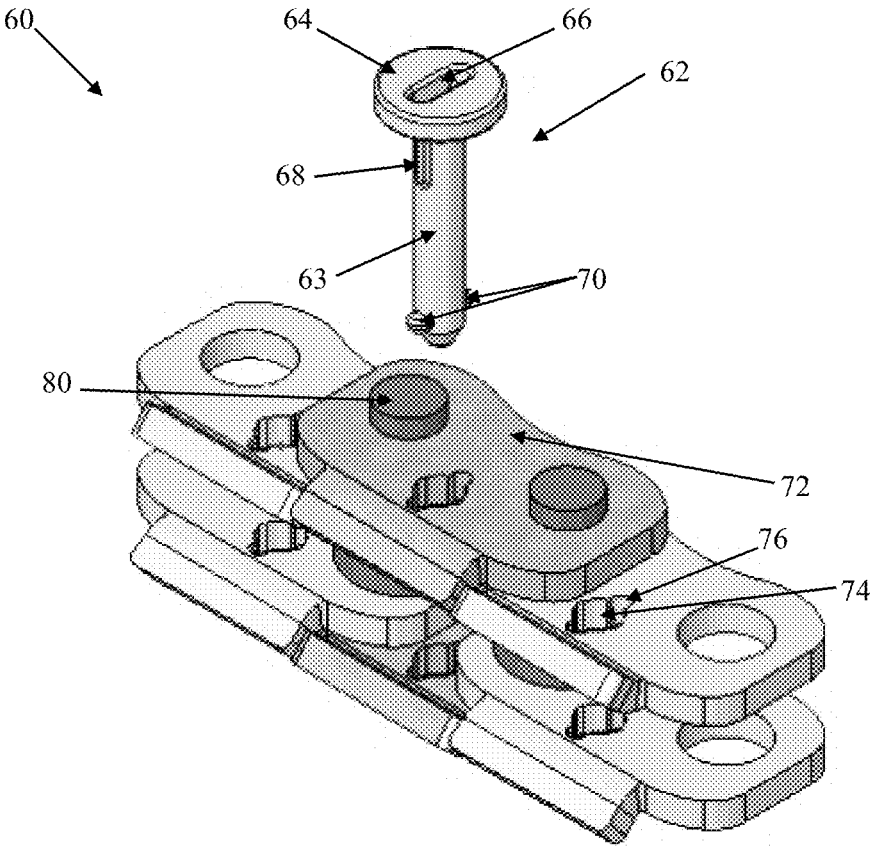
FIG. 7 is another view of part of an incremental chain limiting assembly.
Figure 8:
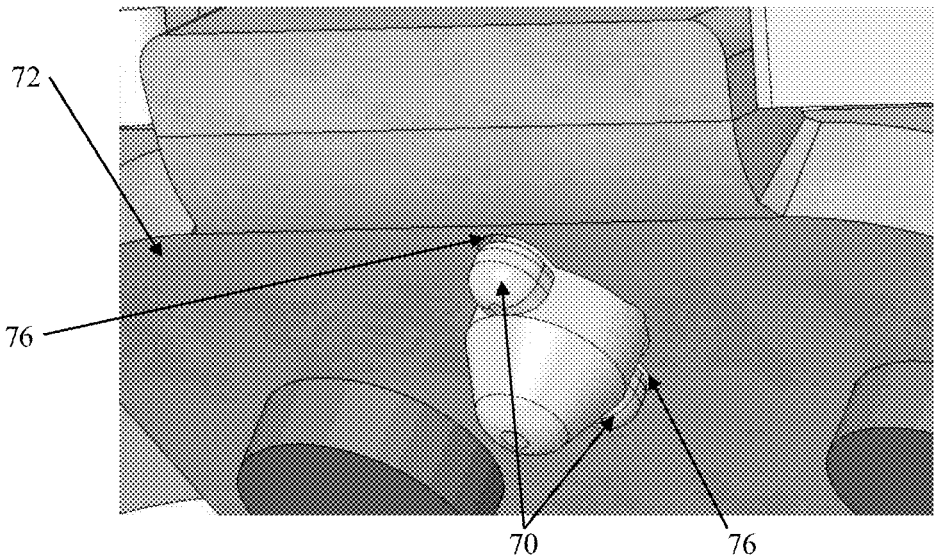
FIG. 8 is a detailed view of a chain limiter plug in an unlocked position.

With reference to FIGS. 3-5, there is shown a mechanical clutch 33 as described above with reference to FIG. 2. In FIG. 5, the main gear 34 has been depicted as transparent to better illustrate the interaction between the clutch gear 36 and the main gear 34. As shown in FIG. 2, the clutch gear 36 may be accessed through the aperture 6, as shown in FIG. 1. As can be seen in FIG. 5, when the clutch gear 36 is depressed against the biasing force of the spring (not shown) into the second position, the male splines of the clutch gear 36 do not engage with the female splines of the main gear 34. In this position, rotation of either of the main gear 34 or the sprocket 38 does not cause rotation of the other. This enables the chain 60, shown in FIG. 2, to be extended out from or retracted back into the casing 8 shown in FIG. 1 without operating the extension means.

Figure 9:
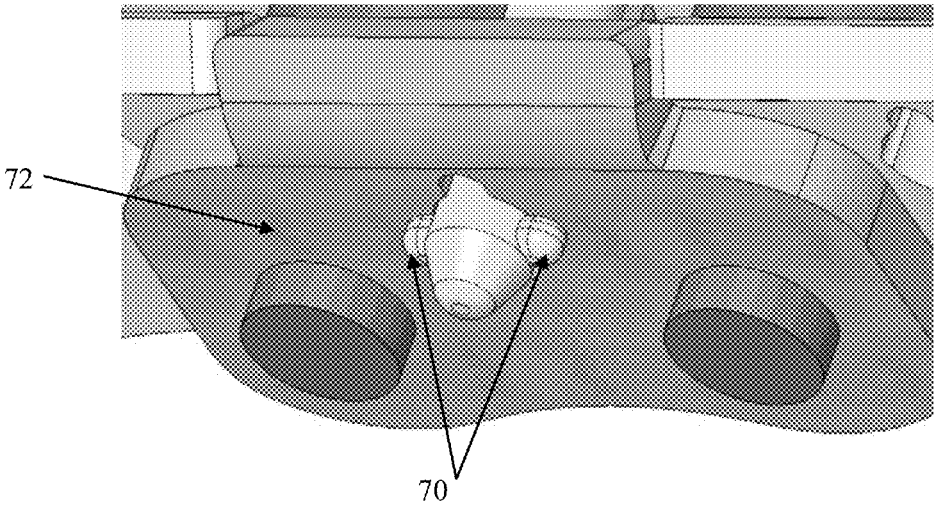
FIG. 9 is a detailed view of the chain limiter plug in a locked position.
Figure 10:
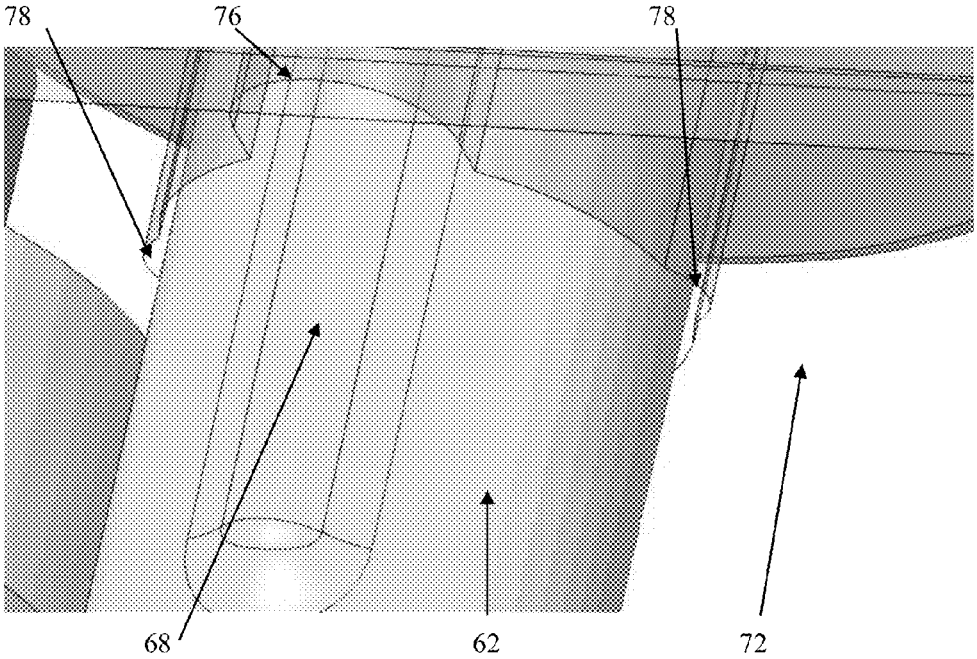
FIG. 10 is another detailed view of the chain limiter plug in the unlocked position.
Figure 11:
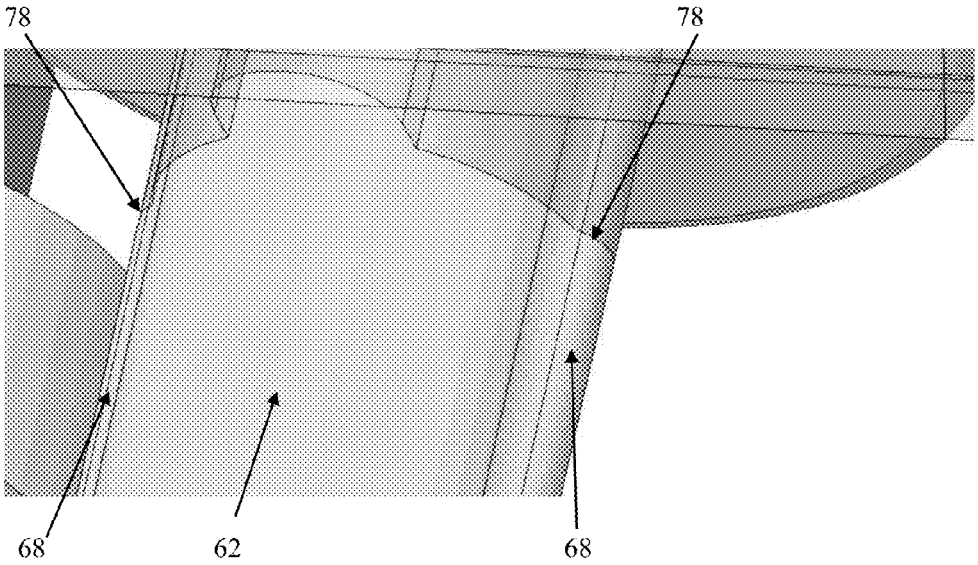
FIG. 11 is another detailed view of the chain limiter plug in the locked position.
Figure 12:
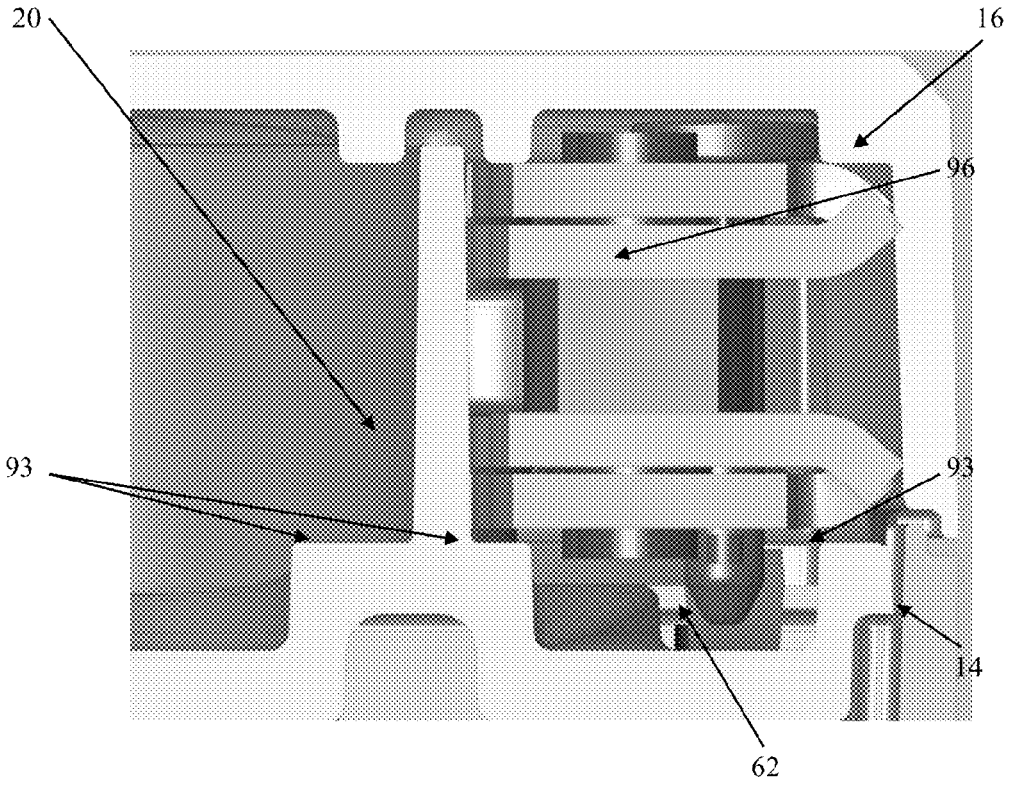
FIG. 12 is a sectioned view of, inter alia, a chain guide.

With reference to FIGS. 6-11, there is shown an incremental chain limiting assembly. A chain assembly 60 comprises outer chain-link plates 72 and inner chain-link plates 73 held together by stepped plate pins 80. It will be appreciated that an actual chain assembly will have more outer chain-link plates 72, inner chain-link plates and stepped plate pins 80 than are depicted in FIGS. 6-11. The outer chain-link plates 72 can be used as either an upper outer or lower outer chain-link plate, depending on the orientation of the chain-link plate. The inner chain-link plates 73 can be used as either an upper inner or lower inner chain-link plate, depending on the orientation of the chain-link plate. Each chain-link plate 72 and inner chain-link plate 73 has a shaped opening in the form of an aperture 74. The apertures 74 have further apsidal openings in the form of grooves 76 and small deformation of the periphery in the form of notches 78 which will be explained in greater detail below. A chain limiter plug 62 (best seen in FIG. 7) can be inserted through outer chain-link plates 72 or inner chain-link plates 73. The chain limiter plug 62 has a substantially cylindrical body 63, a head 64 with a slot 66 which is able to be operated by a tool (not shown). Ridges 68 are located on the body 63 towards the head 64. Extension portions in the form of knobs 70 are located on the body 63 towards the end that is away from the head 64. As can be seen from FIGS. 8 and 9, when the chain limiter plug 62 is inserted through the chain-link plates 72, the knobs 70 pass through the grooves 76. When the chain limiter plug 62 is locked in position (by turning the chain limiter plug 62 by 90° as can be seen in FIG. 9) the knobs 70 lock against the chain-link plate 72. The chain limiter plug 62 is prevented from being removed from the chain-link plates 72 unless the knobs 70 are correctly aligned with the grooves 76. As can be seen from FIGS. 10 and 11, when the chain limiter plug 62 is inserted through the chain-link plates 72, the ridges 68 pass partially through the grooves 76. When the chain limiter plug 62 is turned by 90° as can be seen in FIG. 11, the ridges 68 are held in position by the notches 78 as rotating the ridges 68 to this position or out of this position requires force to overcome the compressive force between the ridges 68 and the aperture 74.

With reference to FIGS. 12-14, 16 and 17 there is shown a chain guide assembly. The chain guide 20 inserts and is secured into the base 14. A corresponding chain guide path 92 is cast as part of the cover 16. The chain 96 follows the profile of the chain guide 20 and chain guide path 92 when extraction or retraction of the chain occurs. As seen from FIG. 13, the chain guide 20 has a substantially 'paper clip' like path such that the chain 96 can 'curl' upon itself not just once but twice. As can be seen in FIGS. 13 and 14, the chain guide 20 has a rib 94 which provides for limited movement of the chain 96 such that the chain 96 does not jam or lock up on the final loop back on itself. A bump 95 on the rib 94 deflects or 'kicks' the chain 96 outwardly such that the chain 96 does not jam or lock up. FIG. 15 illustrates a jam or lock up of a chain 96 which could occur if a rib is not provided. The chain guide 20 has raised shoulders to support the chain 96 such that there is no load applied to the chain limiter plug 62 from the chain guide 20. To assist the chain 96 to 'loop back' on itself, a lower level shoulder 91 is provided. The lower level shoulder 91 causes the outer side of the chain 96 to lower, this makes it easier for the chain 96 to 'loop back' on itself without jamming or locking up. It will be appreciated that as the chain winder (not shown) can be inverted, the corresponding chain guide path 92 in the cover 16 will also be provided with corresponding shoulders (not shown) which will act in the same way when the chain winder (not shown) is inverted. A leaf spring 90 is depressed by the chain limiter plug 62 when it passes over the leaf spring 90. When the leaf spring 90 is depressed, it in turn depresses a microswitch (not shown).

The foregoing embodiments are illustrative only of the principles of the invention, and various modifications and changes will readily occur to those skilled in the art. The invention is capable of being practiced and carried out in various ways and in other embodiments. It is also to be understood that the terminology employed herein is for the purpose of description and should not be regarded as limiting.

In the present specification and claims (if any), the word "comprising" and its derivatives including "comprises" and "comprise" include each of the stated integers but does not exclude the inclusion of one or more further integers.

Reference throughout this specification to "one embodiment", or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A chain winder comprising:

a casing having an aperture;

a chain having at least one end housed within the casing when the chain extends out of the casing;

electrically operated extension means housed within the casing and operable to cause the chain to extend out from the casing and also to retract back into the casing; and a clutch mechanism that is housed within the casing and engageable with the chain, the clutch mechanism being moveable between a first position and a second position and manually accessible from outside the casing through the aperture of the casing to move from the first position to the second position, wherein the clutch mechanism is engaged with the electrically operated extension means when in the first position and disengaged from the electrically operated extension means when in the second position, and wherein the clutch mechanism allows the chain to be extended out from the casing or retracted back into the casing without electrically operating the extension means, when the clutch mechanism is in the second position.

2. The chain winder as claimed in claim 1, wherein the extension means comprises an electric motor.

3. The chain winder as claimed in claim 1, wherein the clutch mechanism comprises:

a drive gear;

a rotatable driven gear which is operatively associated with the chain of the electric chain winder such that rotation of the driven gear in a first direction causes extension of the chain relative to the casing and rotation of the driven gear in a second direction causes retraction of the chain relative to the casing;

a clutch gear which can move between a first position and a second position; and a biasing member for biasing the clutch gear into the first position;

wherein, in the first position the clutch gear is operatively engaged with the drive gear and the driven gear such that rotation of either of the drive gear or the driven gear causes rotation of the other of the respective drive or driven gear, and in the second position the clutch gear is operatively disengaged from at least one of the drive gear and the driven gear against the bias of the biasing member such that rotation of either of the drive gear or the driven gear does not cause rotation of the other of the respective drive or driven gear.

4. The chain winder as claimed in claim 3, wherein, in use, the drive gear is rotatably mounted relative to the casing and is operatively associated with the extension means such that operation of the extension means causes rotation of the drive gear.

5. The chain winder as claimed in claim 4, wherein the clutch gear moves linearly between the first position and the second position.

6. The chain winder as claimed in claim 5, wherein the drive gear has a clutch gear receiving aperture which receives a first portion of the clutch gear, the first portion of the clutch gear being linearly movable within the clutch gear receiving aperture relative to the drive gear when the clutch gear moves between the first and second positions, the clutch pear receiving aperture further including one or more engagement portions which engage with one or more corresponding engagement portions on the first portion of the clutch gear when the clutch gear is in the first position such that neither the drive gear nor clutch gear can rotate without causing rotation of the other, but the drive gear engagement portions disengage from the engagement portions on the first portion of the clutch gear when the clutch gear is in the second position such that the drive gear or clutch gear can rotate without causing rotation of the other.

7. The chain winder as claimed in claim 6, wherein the driven gear has an opening which receives a second portion of the clutch gear, the second portion of the clutch gear being linearly movable within the opening relative to the driven gear when the clutch gear moves between the first and second positions, the opening further including one or more engagement portions which engage with one or more corresponding engagement portions on the second portion of the clutch gear when the clutch gear is in the first position and also when the clutch gear is in the second position.

8. The chain winder as claimed in claim 7, wherein the engagement portions on the drive gear and the corresponding engagement portions on the first portion of the clutch gear comprise mutually engageable teeth, crenellations or splines, and whilst not necessarily the same, the engagement portions on the driven gear and the corresponding engagement portions on the second portion of the clutch gear comprise mutually engageable teeth, crenellations or splines.

9. The chain winder as claimed in claim 1, which can be operated to extend and retract the chain, wherein the chain includes openings at a plurality of locations along the chain, each said opening being operable to receive a removable chain limiter plug, wherein the chain limiter plug can be inserted into an opening at a desired location along the chain so as to define a desired amount of chain extension, and during operation of the electric chain winder to extend the chain, when the chain limiter plug reaches a predetermined position relative to the electric chain winder an extension stop mechanism is operated preventing further extension of the chain.

10. The chain winder as claimed in claim 9, wherein the electric chain winder has an electric motor for extending and retracting the chain, and the extension stop mechanism includes a microswitch which is functionally linked to the electric motor and positioned such that when the chain limiter plug moves into contact with the microswitch further extension of the chain is prevented.

11. The chain winder as claimed in claim 1, further comprising a chain guide, for guiding movement of the chain inside the electric chain winder, the chain guide defining a chain guide path along which the chain moves during extension and retraction of the chain, the chain guide path having at least two substantially parallel linear sections linked by a curved section, an outer side of the chain guide path being defined by an outer wall and an inner side of the chain guide path being defined by an inner wall, the chain guide further including a rib that abuts the chain as the chain moves through the curved section thereby guiding the chain about the radius of the curved section and preventing links of the chain jamming against themselves or against the outer wall.

12. The chain winder as claimed in claim 11 wherein the chain guide path is provided with two shoulders, one towards the outer side of the chain guide path and the other towards the inner side of the chain guide path, wherein at least one shoulder is at, or descends to, a lower level in at least one of the curved sections compared to the height of the said shoulder in parallel linear sections of the chain guide path.

13. The chain winder as claimed in claim 11, wherein the chain guide path has three substantially parallel linear sections and two curved sections, one of the curved sections linking the first and second of the parallel linear sections, and the other curved section linking the second and third of the parallel linear sections.

14. A clutch mechanism for use located within a casing of a chain winder as claimed in claim 1, the clutch mechanism comprising:

a drive gear;

a rotatable driven gear which, in use, is operatively associated with the chain of the chain winder such that rotation of the driven gear in a first direction causes extension of the chain relative to the casing and rotation of the driven gear in a second direction causes retraction of the chain relative to the casing;

a clutch gear which can move between a first position and a second position from outside the casing of the chain winder; and a biasing member for biasing the clutch gear into the first position;

wherein, in the first position the clutch gear is operatively engaged with the drive gear and the driven gear such that rotation of either of the drive gear or the driven gear causes rotation of the other of the respective drive or driven gear, and in the second position the clutch gear is operatively disengaged from at least one of the drive gear and the driven gear against the bias of the biasing member such that rotation of either of the drive gear or the driven gear does not cause rotation of the other of the respective drive or driven gear.

15. The clutch mechanism as claim in claim 14, wherein, in use, the drive gear is rotatably mounted relative to the casing and is operatively associated with the extension means such that operation of the extension means causes rotation of the drive gear.

16. The clutch mechanism as claim in claim 15, wherein the clutch gear moves linearly between the first position and the second position.

17. The clutch mechanism as claimed in claim 16, wherein the drive gear has a clutch gear receiving aperture which receives a first portion of the clutch gear, the first portion of the clutch gear being linearly movable within the clutch gear receiving aperture relative to the drive gear when the clutch gear moves between the first and second positions, the clutch gear receiving aperture further including one or more engagement portions which engage with one or more corresponding engagement portions on the first portion of the clutch gear when the clutch gear is in the first position such that neither the drive gear nor clutch gear can rotate without causing rotation of the other, but the drive gear engagement portions disengage from the engagement portions on the first portion of the clutch gear when the clutch gear is in the second position such that the drive gear or clutch gear can rotate without causing rotation of the other.

18. The clutch mechanism as claimed in claim 17, wherein the driven gear has an opening which receives a second portion of the clutch gear, the second portion of the clutch gear being linearly movable within the opening relative to the driven gear when the clutch gear moves between the first and second positions, the opening further including one or more engagement portions which engage with one or more corresponding engagement portions on the second portion of the clutch gear when the clutch gear is in the first position and also when the clutch gear is in the second position.

19. The clutch mechanism as claimed in claim 18, wherein the engagement portions on the drive gear and the corresponding engagement portions on the first portion of the clutch gear comprise mutually engageable teeth, crenellations or splines, and whilst not necessarily the same, the engagement portions on the driven gear and the corresponding engagement portions on the second portion of the clutch gear comprise mutually engageable teeth, crenellations or splines.

* * * * *